US010203109B2

(12) United States Patent
Reese et al.

(10) Patent No.: US 10,203,109 B2
(45) Date of Patent: Feb. 12, 2019

(54) SYSTEMS AND METHODS FOR AGITATING FUEL WITHIN A HEAT EXCHANGER

(71) Applicant: Central Boiler Inc., Greenbush, MN (US)

(72) Inventors: Mark Reese, Roseau, MN (US); Dennis Brazier, Greenbush, MN (US)

(73) Assignee: Central Boiler Inc., Greenbush, MN (US)

( * ) Notice: Subject to any disclaimer, the term of this patent is extended or adjusted under 35 U.S.C. 154(b) by 561 days.

(21) Appl. No.: 14/865,423

(22) Filed: Sep. 25, 2015

(65) Prior Publication Data

US 2017/0089568 A1 Mar. 30, 2017

(51) Int. Cl.

| | |
|---|---|
| ***F23B 30/00*** | (2006.01) |
| ***F24B 9/04*** | (2006.01) |
| ***F23B 60/02*** | (2006.01) |
| ***F24H 1/41*** | (2006.01) |

(52) U.S. Cl.

CPC ..... *F23B 30/00* (2013.01); *F23B 60/02* (2013.01); *F24B 9/04* (2013.01); *F24H 1/41* (2013.01)

(58) Field of Classification Search

CPC ..... F23B 30/00; F24B 9/04
USPC ..... 110/258; 126/173
See application file for complete search history.

(56) References Cited

U.S. PATENT DOCUMENTS

| | | | |
|---|---|---|---|
| 4,201,186 | A | 5/1980 | Paquin |
| 4,303,198 | A | 12/1981 | Dulac |
| 4,312,278 | A | 12/1982 | Smith |
| 4,479,605 | A | 10/1984 | Billotte |
| 4,517,903 | A | 5/1985 | Richmond |
| 4,574,712 | A | 3/1986 | David |
| 4,947,769 | A | 8/1990 | Whitfield |
| 5,001,993 | A | 3/1991 | Gramlow |
| 5,263,642 | A | 12/1993 | Orchard |
| 5,284,103 | A | 2/1994 | Hand |
| 5,329,920 | A | 7/1994 | Brazier |
| 5,873,356 | A | 2/1999 | Vossler |
| 5,893,358 | A | 4/1999 | Whitfield |

(Continued)

FOREIGN PATENT DOCUMENTS

JP 05138144 A * 6/1993

OTHER PUBLICATIONS

International Search Report; dated Dec. 20, 2016; pp. 4.

*Primary Examiner* — Avinash Savani
*Assistant Examiner* — Aaron Heyamoto
(74) *Attorney, Agent, or Firm* — Lowe Graham Jones PLLC

(57) ABSTRACT

A burn box includes a font, a rear, a first and a second side, a lower, and an upper interior surface, as well as a first push member, a first coupler, and a first torque member. The first push member includes a first end, a second end, and a first coupler portion. The first coupler pivotally couples the first coupler portion to the first interior surface. The second end is vertically intermediate the first end and the lower interior surface. The first torque member provides a first torque to the first push member. When the first torque is provided to the first push member, the first push member rotates about a first rotational axis. The first rotational axis is through the first coupler portion of the first push member. The first rotational axis is parallel to the longitudinal axis. The second end rotates toward the second side interior surface.

31 Claims, 6 Drawing Sheets

(56) References Cited

U.S. PATENT DOCUMENTS

| | | | | |
|---|---|---|---|---|
| 7,004,084 | B1 | 2/2006 | Anderson | |
| 7,438,024 | B2 | 10/2008 | Bast | |
| 7,721,661 | B2 | 5/2010 | Nelson | |
| 2007/0113761 | A1* | 5/2007 | Cole | F23G 5/027 110/229 |
| 2008/0156237 | A1* | 7/2008 | Leihgeber | F23B 30/00 110/258 |
| 2013/0133560 | A1* | 5/2013 | Laskowski | F23N 1/02 110/190 |
| 2013/0152913 | A1* | 6/2013 | Raghavan | A21B 3/04 126/20 |
| 2013/0186313 | A1 | 7/2013 | Walborn | |

* cited by examiner

SYSTEMS AND METHODS FOR AGITATING FUEL WITHIN A HEAT EXCHANGER

FIELD OF THE INVENTION

The present disclosure relates to systems and methods for agitating fuel within a heat exchanger and, more particularly, to systems and methods for automatically agitating a burning woodpile within a boiler.

BACKGROUND

Heat exchangers selectively transfer thermal energy from a thermal source to a thermal destination. One example of a heat exchanger is a boiler. The combustion of fuel (the thermal source) within the boiler releases thermal energy. A thermally conducting fluid or gas, such as water, captures the released thermal energy, via a heat exchange process. Plumbing or ducts selectively channel and/or deliver the heated water from the boiler, to another structure, such as a home (the thermal destination). At the home, the released thermal energy is at least partially extracted from the flowing water and used for other purposes, such as heating the home.

Various boilers use wood as the combustible fuel. Such boilers may include a burn box that houses a pile of burning wood. The burning of the wood releases the thermal energy that is ultimately delivered to the home. As wood is added to the woodpile or as the wood burns, periodically stoking and/or agitating the woodpile increases the efficiency of the burn and thus the overall efficiency of the boiler. It is for these and other concerns that the following disclosure is provided.

SUMMARY OF THE INVENTION

In some embodiments, a burn box houses wood. The burn box includes a font interior surface, a rear interior surface, a first side interior surface, a second side interior surface, a lower interior surface, and an upper interior surface, a first push member, a first coupler, and a first torque member. A longitudinal axis extends between the front interior surface and the rear interior surface. A lateral axis extends between the first side interior surface and the second side interior surface. The lateral axis is substantially orthogonal to the longitudinal axis. A vertical axis extends between the lower interior surface and the upper interior surface. The vertical axis is substantially orthogonal to at least one of the longitudinal axis or the lateral axis.

The first push member includes a first end, a second end, and a first coupler portion intermediate the first end and the second end. The first coupler pivotally couples the first coupler portion of the first push member to the first interior surface. The second end is vertically intermediate the first end and the lower interior surface. The first torque member provides a first torque to the first push member. When the first torque is provided to the first push member, the first push member rotates about a first rotational axis. The first rotational axis is through the first coupler portion of the first push member. The first rotational axis is parallel to the longitudinal axis. The second end rotates toward the second side interior surface.

In at least one embodiment, the first torque member includes a lower portion and an upper portion. The upper portion contacts a contact portion of the first push member. The contact portion of the first push member is vertically between the second end and the coupler portion of the first push member. The first torque member rotates about a second rotational axis. The second rotational axis is parallel to the first rotational axis. When the upper portion rotates toward the second side interior surface, the upper portion provides the first torque on the first push member.

The burn box may further include a first drive member. The first drive member is rigidly coupled to the first torque member. The first drive member drive member is rotates about a second rotational axis. The second rotational axis is parallel to the first rotational axis. When the first drive member is rotated about the second rotational axis, the first torque member engages the first push member to provide the first torque. The first drive member extends between the front interior surface and the rear interior surface and along the second rotational axis. In other embodiments, the burn box includes an actuator that automatically rotates the first drive member about the second rotational axis. The first drive member may extend beyond an exterior surface of the box. The first drive member is rotatable from an exterior region of the box.

In some embodiments, the burn box further includes a second push member, a second coupler, and a second torque member. The second push member includes a third end, a fourth end, and a second coupler portion. The second coupler portion is between the third end and the fourth end. The second coupler pivotally couples the second coupler portion of the second push member to the second interior surface. The fourth end is vertically between the third end and the lower interior surface. The second torque member provides a second torque to the second push member. When the second torque is provided to the second push member, the second push member rotates about a third rotational axis. The third rotational axis is through the second coupler portion of the second push member. The third rotational axis is parallel to the longitudinal axis. The fourth end rotates toward the first side interior surface.

The burn box may further include a first actuator and a second actuator. The first actuator automatically rotates the first torque member about a second rotational axis. The second rotational axis is parallel to the first rotational axis. When the first torque member is rotated about the second rotational axis, the first torque member engages the first push member to provide the first torque. The second actuator automatically rotates the second torque member about a fourth rotational axis. The fourth rotational axis is parallel to the first rotational axis. When the second torque member is rotated about the fourth rotational axis, the second torque member engages the second push member to provide the second torque. The first and second actuators rotate the first and second torque members preferably sequentially, alternatively simultaneously. The first torque is provided to the first push member and the second torque is provided to the second push member in a temporally alternating sequence.

In some embodiments, the burn box further includes a door, a door sensor, and an actuator. The door provides access to an interior of the box. The door sensor generates a signal when the door is transitioned from an open state to a closed state. The actuator initiates the first torque member providing the first torque to the first push member based on receiving the signal generated by the door sensor.

In various embodiments, a system is for agitating a pile of wood in a burn box. The agitating system includes a first agitator rod, a first pivotal fastener, a first drive rod, and a first engaging member. The first agitator rod includes a first end and a second end. The first pivotal fastener pivotally couples the first agitator rod to an upper portion of a first lateral internal surface of the box. The second end of the first agitator rod is vertically between a lower internal surface of the box and the first end of the first agitator rod. The first drive rod rotates about a first rotational axis. The first rotational axis extends between a front internal surface of the box and an opposing rear internal surface of the box. The first engaging member is rigidly coupled to the first drive rod. The first engaging member engages the first agitator rod. When the first drive rod is rotated in a first direction along the first rotational axis, the first engaging member engages the first agitator rod. The second end of the first agitator rod rotates about a second rotational axis and towards a second lateral internal surface of the box that opposes the first lateral internal surface. The second rotational axis is parallel to the first rotational axis.

In at least one embodiment, when the first drive rod is rotated in a second direction that is opposite the first direction, the first engaging member engages the first agitator rod. The second end of the first agitator rod rotates about the second longitudinal axis and towards the first lateral internal surface of the box. The first engaging member may include an upper surface and an aperture positioned on the upper surface. The aperture slidably receives the second end of the first agitator rod. When the first drive rod rotates about the first longitudinal axis, the first agitator rod slides along a surface of the aperture.

A lateral width of the aperture may be large enough to slidably receive the second end of the first agitator rod. The first agitator rod and the first engaging member form an angle in a plane that is substantially orthogonal to the first rotational axis and the angle is between 130 and 180 degrees. The surface of the aperture of the first engaging member engages with the first agitator rod to rotate the second end of the first agitator rod about the second rotational axis. The first rotational axis may be vertically below the second rotational axis.

In various embodiments, the system further includes a first actuator. The first actuator is coupled to the first drive rod and positioned external to the box. The first actuator rotates the first drive rod about the first rotational axis. The first actuator rotates the first drive rod based on at least one of an agitation periodicity or a time lapse since a previous agitation event. The system may further include at least one of a door sensor, an oxygen sensor, or a carbon monoxide sensor. The first actuator rotates the first drive rod based on at least a signal generated by at least one of the door sensor, the oxygen sensor, or the carbon monoxide sensor.

The system may further include a second agitator rod, a second pivotal fastener, a second drive rod, and a second engaging member. The second agitator rod includes a third end and a fourth end. The second pivotal fastener pivotally couples the second agitator rod to an upper portion of the second lateral internal surface of the box. The fourth end of the second agitator rod is vertically between the lower internal surface of the box and the third end of the second agitator rod. The second drive rod rotates about a third rotational axis. The third rotational axis extends between the front internal surface of the box and the rear internal surface of the box. The second engaging member is rigidly coupled to the second drive rod. The second engaging member engages the second agitator rod. When the second drive rod is rotated in a third direction along the third rotational axis, the second engaging member engages the second agitator rod. The fourth end of the second agitator rod rotates about a fourth rotational axis and towards the first lateral internal surface of the box. The fourth rotational axis is parallel to the first rotational axis.

In various embodiments, a burn box is included in a heat exchanger. The burn box includes a first interior surface, a second interior surface, a first stoker member, a second stoker member, a first driven member, and a second driven member. The second interior surface opposes the first interior surface. The first stoker member includes an upper portion and a lower portion. The upper portion of the first stoker member is coupled to the first interior surface. The second stoker member includes an upper portion and a lower portion. The upper portion of the second stoker member is coupled to the second interior surface.

The first driven member engages the first stoker member. When driven in a first direction, the first driven member applies a first force on the first stoker member. The first force is directed toward the second interior surface. The lower portion of the first stoker member moves toward the second interior surface. The second driven member engages the second stoker member. When driven in a second direction, the second driven member applies a second force on the second stoker member. The second force is directed toward the first interior surface. The lower portion of the second stoker member moves toward the first interior surface.

In some embodiments, when driven in a third direction, the first driven member applies a third force on the first stoker member. The third force is directed toward the first interior surface. The lower portion of the first stoker member moves toward the first interior surface. When driven in a fourth direction, the second driven member applies a fourth force on the second stoker member. The fourth force is directed toward the second interior surface so. The lower portion of the second stoker member moves toward the second interior surface.

The box may further include a first actuator and a second actuator. The first actuator drives the first driven member in the first direction. The second actuator drives the second driven member in the second direction. The box further includes a first drive component and a second drive component. The first drive component is coupled to the first actuator and the first driven member. The first actuator triggers the first drive component to drive the first driven member in the first direction. The first actuator is coupled to a portion of the first drive component that is positioned external to the box. The second actuator is coupled to a portion of the second drive component that is positioned external to the box.

The first actuator includes a first torque sensor. The first torque sensor terminates driving the first driven member when the first torque sensor senses a first torque that is greater than a predetermined torque value. The second actuator includes a second torque sensor. The second torque sensor terminates driving the second driven member when the second torque sensor senses a second torque that is greater than the predetermined torque value.

In various embodiments, the box further includes a transceiver device that receives a wireless signal generated by a remote device. The first actuator triggers the first drive component to drive the first driven member in the first direction in response to the transceiver device receiving the received wireless signal. The second actuator triggers the second drive component to drive the second driven member in the second direction in response to the transceiver device receiving the received wireless signal.

The box may further include a first drive component and a second drive component. The first drive component is rigidly coupled to the first driven member. The first drive component rotates about a first rotational axis. The first rotational axis is orthogonal to a line extending between the first and the second interior surfaces. When the first drive component is rotated about the first rotational axis, the first driven member is driven in the first direction and the first stoker member rotates about a third rotational axis. The third rotational axis is parallel to and vertically above the first rotational axis. The second drive component is rigidly coupled to the second driven member. The second drive component rotates about a second rotational axis. The second rotational axis is parallel to the first rotational axis. The second rotational axis is positioned laterally between the first rotational axis and the second interior surface. When the second drive component is rotated about the second rotational axis, the second driven member is driven in the second direction and the second stoker member rotates about a fourth rotational axis. The fourth rotational axis is substantially parallel to and vertically above the second rotational axis.

In at least one embodiment, when the first drive component is rotated in a rotational direction, the first stoker member is rotated in another rotational direction. The other rotational direction is substantially parallel to and opposing the rotational direction. When the second drive component is rotated in the other rotational direction, the second stoker member is rotated in the rotational direction.

When the first driven member is driven in the first direction, the first driven member and the first stoker member may co-rotate in opposing directions. A first angle between the first driven member and the first stoker member is varied. When the second driven member is driven in the second direction, the second driven member and the second stoker member co-rotate in opposing directions. A second angle between the second driven member and the second stoker member is varied.

BRIEF DESCRIPTION OF THE DRAWINGS

Preferred and alternative examples of the present invention are described in detail below with reference to the following drawings.

DETAILED DESCRIPTION

To facilitate the understanding of this invention, a number of terms are defined below. Terms defined herein have meanings as commonly understood by a person of ordinary skill in the areas relevant to the present invention. Terms such as "a," "an," and "the" are not intended to refer to only a singular entity, but include the general class of which a specific example may be used for illustration. The terminology herein is used to describe specific embodiments of the invention, but their usage does not delimit the invention, except as outlined in the claims.

Figure 1A:
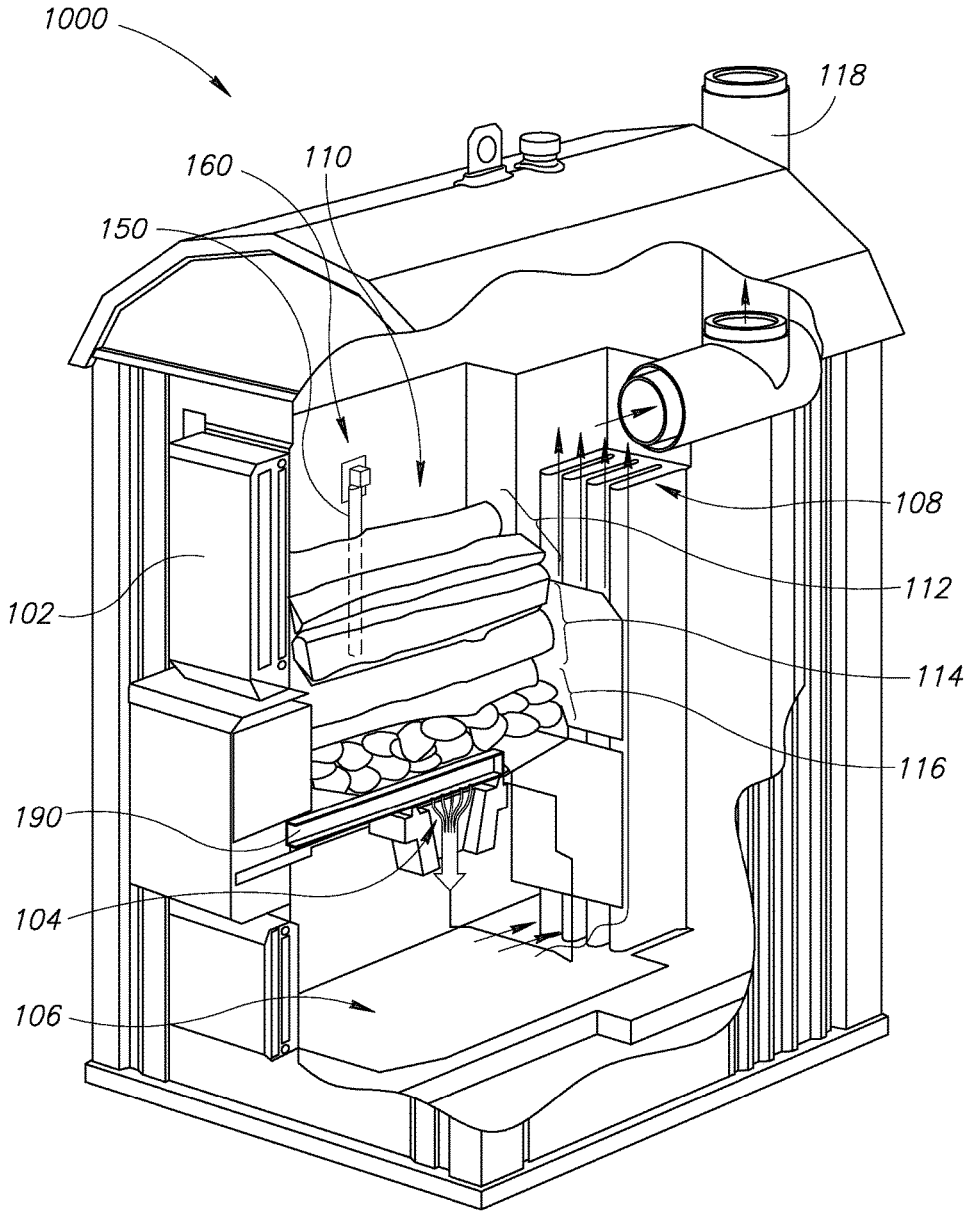
FIG. 1A provides a cutaway view of a heat exchanger that is consistent with the embodiments disclosed here.
Figure 1B:
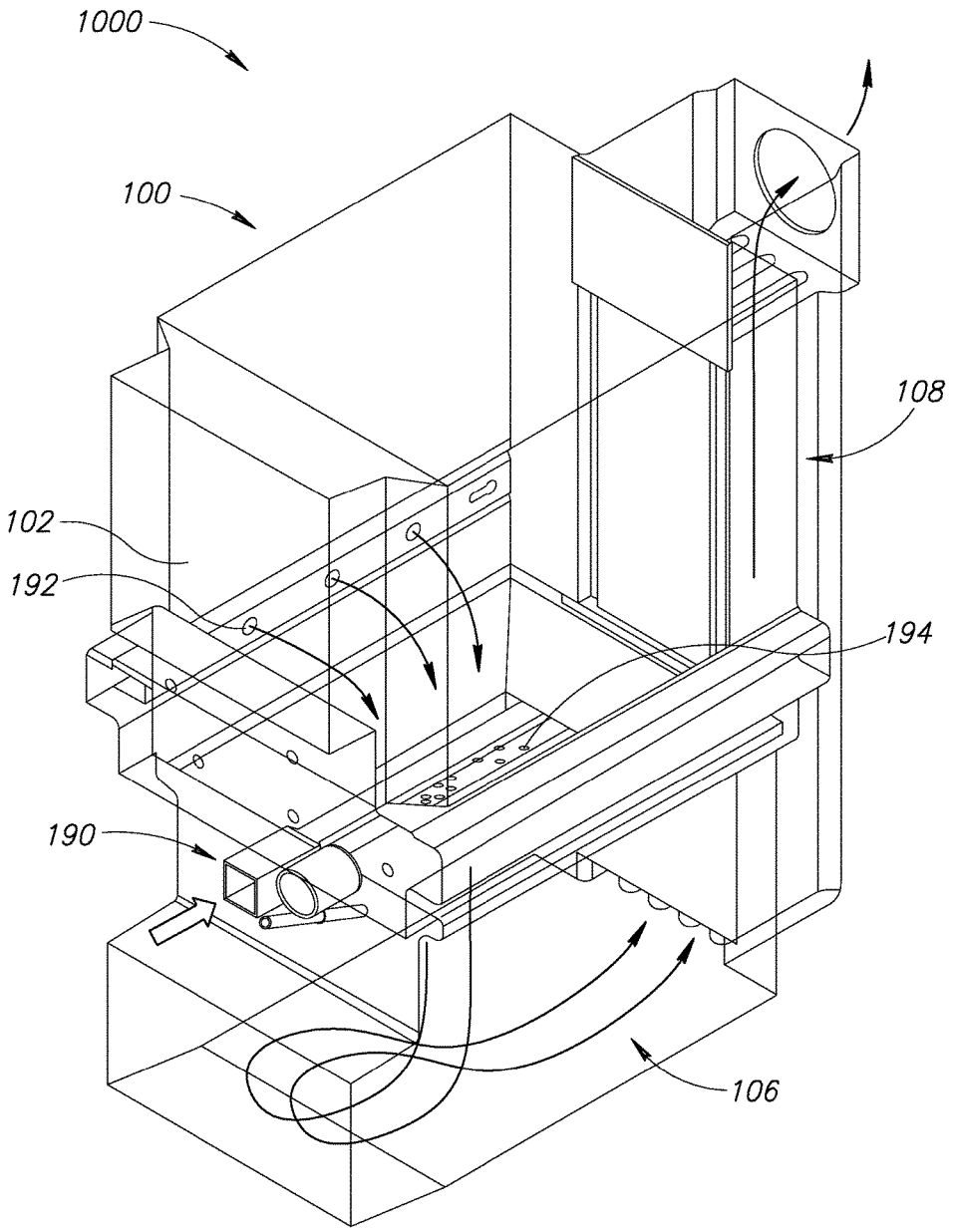
FIG. 1B schematically illustrates a flow of air and gasified fuel within the heat exchanger of FIG. 1A.

FIG. 1A provides a cutaway view of a heat exchanger 1000 that is consistent with the embodiments disclosed here. Heat exchanger 1000 may be a boiler, such as a wood burning boiler. Flow arrows in FIG. 1A show the flow patterns of air and gasified fuel through heat exchanger 1000. FIG. 1B schematically illustrates, with more detail than that provided by FIG. 1A, the flow of air and gasified fuel within the heat exchanger 1000. To demonstrate the details of the airflow internal to the heat exchanger 1000, FIG. 1B illustrates the structures of the heat exchanger 1000 as transparent structures. The fuel is combusted within a burn box, such as burn box 100 of FIG. 1B. Heat exchanger 1000 includes a door 102 that provides a user access to the interior of a burn box 100. The user may replenish or otherwise provide fuel to the burn box 100, via door 102.

In preferred embodiments, the fuel may be wood; however, other embodiments are not so constrained. FIG. 1A shows a burning pile of wood 110 within the burn box 100. The woodpile 110 is essentially burning from the bottom up. The burning woodpile 110 includes at least three layers: a coal layer 116 at the bottom of the pile 110, a burning layer 114, and a drying layer 112 at the top of the pile 110. As shown by the flow arrows in FIG. 1B, a primary flow of external air enters the burn box 100 through a plurality of horizontally arranged primary air apertures or inlet ports. One of the primary air apertures is indicated with the reference numeral 192. In some embodiments, the primary apertures that provide the primary airflow are arranged in a horizontal U-shape. This primary airflow at least partially provides the oxygen required for the combustion of the woodpile 110. For purposes of clarity, the primary airflow entering the burn box 100 from the primary air apertures is shown in FIG. 1B through only three of the primary air apertures (including primary air aperture 192). However, it should be understood that the primary airflow is entering the burn box 100 through each of the primary air apertures.

As also shown by the flow arrows of FIGS. 1A-1B, a secondary airflow is introduced into the bottom portion of the burn box 100. The secondary airflow is provided by secondary intake duct 190. A plurality of secondary air apertures positioned on a bottom surface of the secondary intake duct 190 introduces the secondary airflow into the bottom portion of the burn box 100. One of the secondary air apertures is indicated by the reference numeral 194 in FIG. 1B. In various embodiments, the secondary intake duct 190 (or at least the secondary air apertures) is positioned below the coal layer 116 shown in FIG. 1A.

In the bottom portion of the burn box 100, the primary airflow and the secondary airflow are mixed or otherwise combined. Near the bottom of the burn box 100, the mixture of the primary and secondary airflows include partially gasified and/or combusted fuel. The mixture of the primary and secondary airflows flows downward through the aperture 104 in the lower interior surface or floor of the burn box 100 and into a reaction chamber 106 that is positioned vertically below the burn box 100.

In some embodiments, burn box 100 includes a grate, mesh, or filter. Although not shown in FIGS. 1A-1B, such a grate or mesh ensures that aperture 104 does not become impacted or clogged by ash, coals, charcoal, and other sediments. Such an impaction would prevent the flow of the combination of primary and secondary airflows through aperture 104 and into reaction chamber 106. The grate may be positioned vertically above or below the secondary air apertures and above aperture 104. In some embodiments, the grate may at least partially make up the floor of the burn box 100. The grate may include small openings to allow the flow of gasified fuel into aperture 104 and into the reaction chamber 106. The fuel combustion process continues within a reaction chamber 106.

As shown in detail in FIGS. 1A-1B, the primary airflow generates a downdraft through the pile 110 and combines with the secondary airflow near the bottom of the burn box 100. The secondary airflow provides a flow of oxygen to the gasified fuel that forces the gasified fuel into reaction chamber 106. At least due to the oxygen provided by the secondary airflow, the gasified fuel will continue to react (burn) within the reaction chamber 106 to ensure a more complete burn of the fuel. A more complete burn provides a greater efficiency for heat exchanger 1000.

Upon continued reaction with the reaction chamber 106, the gasified fuel flows through heat exchanger fins 108. The heated gas provides thermal energy to water or another thermally conducting liquid within thermal contact with the heat exchanger fins 108. For instance, a water jacket may be internal or external to the heat exchanger fins 108. The heated water in the jacket is directed to another structure, such as a home. The flow of the heated water provides the home a portion of the energy released during the combustion of the woodpile 110. An exhaust port or chimney 118 directs and carries exhaust from the combustion process away from the heat exchanger 1000.

When a woodpile 110 burns from the bottom up, with a downdraft and/or downward gas effluent flow as shown in FIG. 1B, the upper portions of the burning layer 114 or the drying layer 112 may form a bridge as the wood underneath these layers combusts. This bridging effect may decrease the efficiency of the heat exchanger 1000. The combustion primarily occurs in a lower portion of the burning layer 114 and an upper portion of the coal layer 116. In some conditions, the wood in the upper portion of the burning layer 114 may form a somewhat stable bridge. This bridge inhibits the wood in the upper portion of the burning layer 114 and the drying layer 112 from falling downward to where the combustion is primarily occurring. This bridging effect slows the combustion rate and thus decreases the efficiency of heat exchanger 1000. If the bridging is stable enough, the combustion may be extinguished altogether.

Accordingly, heat exchanger 1000 includes a system for pushing, shaking, disrupting, agitating, stoking, or otherwise destabilizing the bridging effect in the burning woodpile 110. Such an agitating system may include a push member 150. A coupler or fastener 160 couples the push member 150, or stoker, to an internal surface of the burn box 100. The push member 150 rotates and/or pivots about coupler 160 and towards the woodpile 110. When rotated towards pile 110, push member 150 pushes, disrupts, and/or agitates the burning layer 114 of woodpile 110, and de-stabilizes the bridging effect. Such destabilizing of the bridging effect increases the efficiency of the heat exchanger 1000.

In preferred embodiments, the size and positioning of push member 150 is chosen so that the lower (stoker) portion of the push member 150 engages and interacts with the portion of the woodpile 110 that is prone to bridging, such as the burning layer 114. Agitating woodpile 110 provides the further benefit of insuring that the coal layer 116 does not plug or otherwise obstruct the opening 104 in the floor of the burn box 100, further increasing the efficiency of heat exchanger 1000. Although not shown in FIG. 1A, another push member may be included and coupled to an opposing interior surface of the burn box 100. The other push member may stoke or agitate the pile 110 from the other side.

As discussed further below, the shaking or agitating of the burning pile 110 may be automatically triggered so that any bridging of the wood in the pile 110 is collapsed or destabilized as needed, automatically increasing the efficiency of the heat exchanger 1000. The stoking may be triggered periodically based on variable and/or constant time intervals, or in response to inputs, such as the timing of a previous opening of door 102, the timing of a previous agitating sequence, the temperature internal to the burn box 100 or of the water jacket, a gas sensor reading, or the like.

Figure 2A:
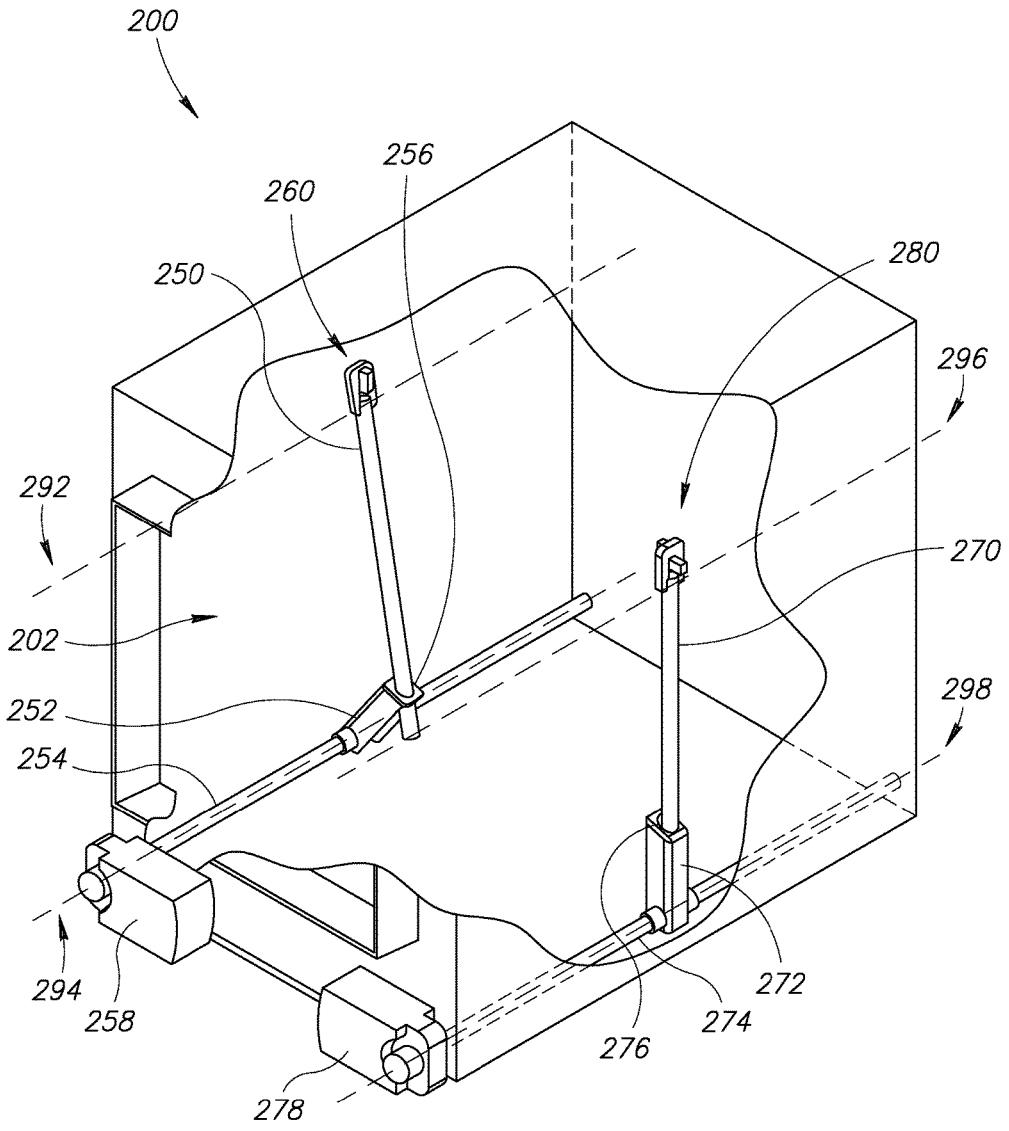
FIG. 2A shows a cutaway perspective view of a burn box, which is consistent with various embodiments included in the heat exchanger of FIG. 1A.
Figure 2B:
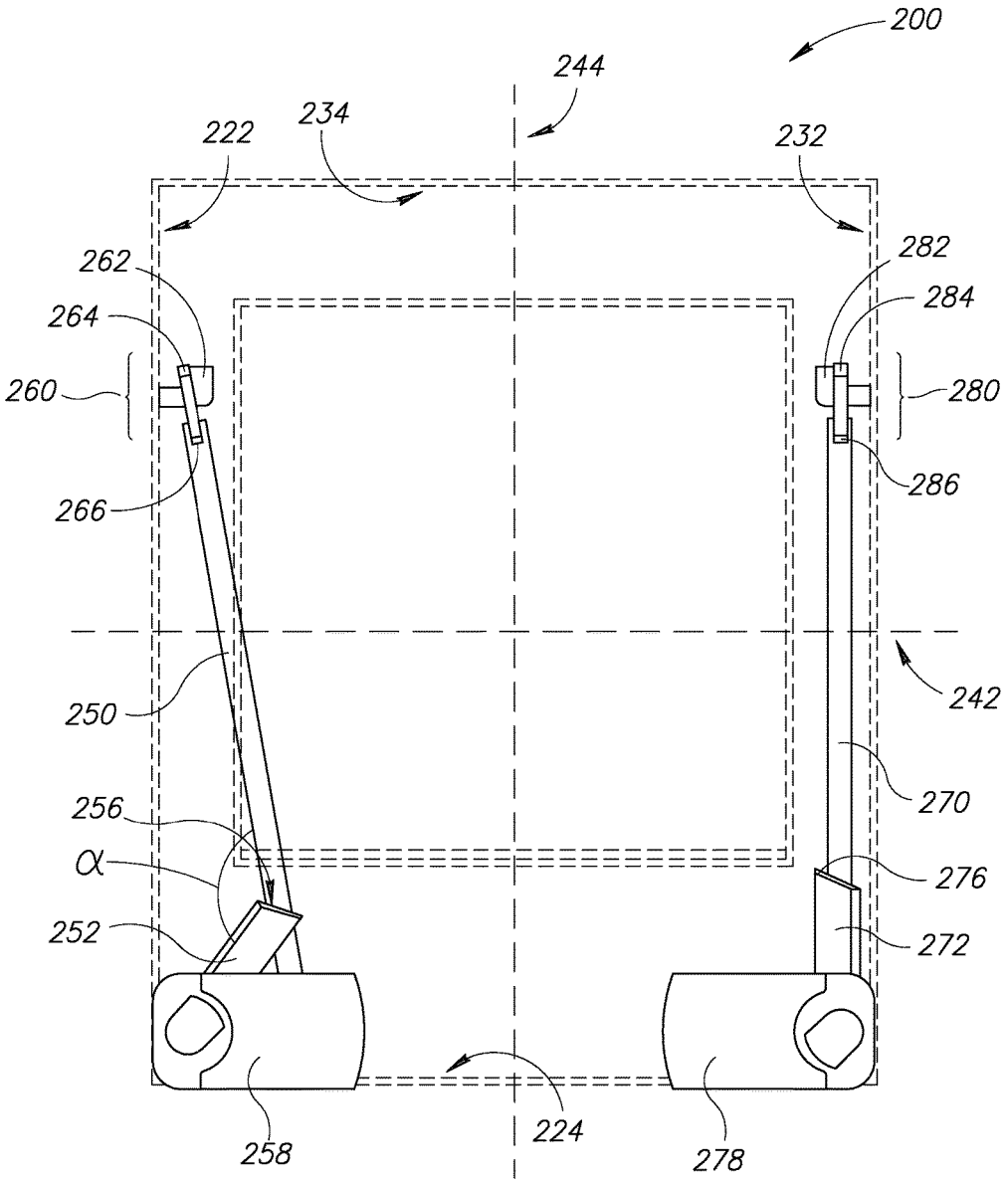
FIG. 2B shows a front view of the burn box of FIG. 2A.
Figure 2C:
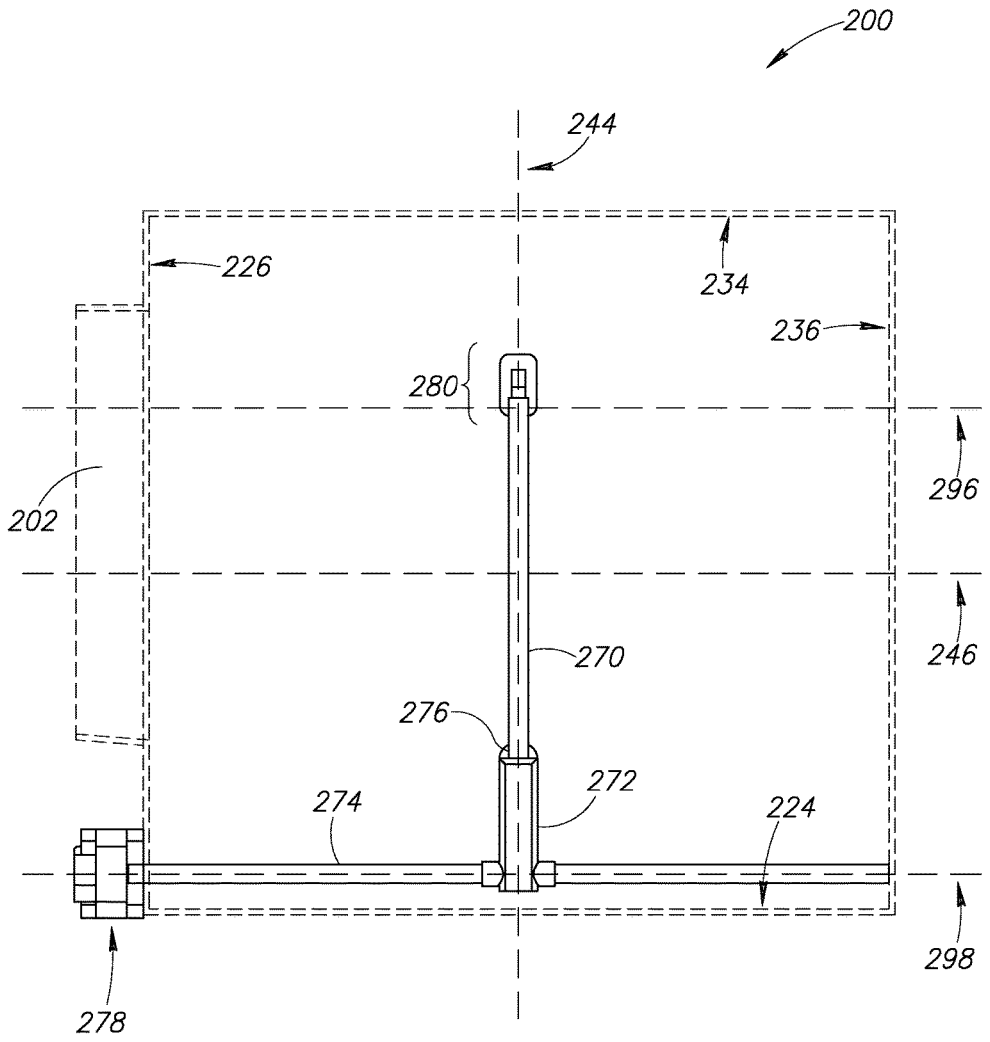
FIG. 2C shows a side view of the burn box of FIG. 2A.
Figure 2D:
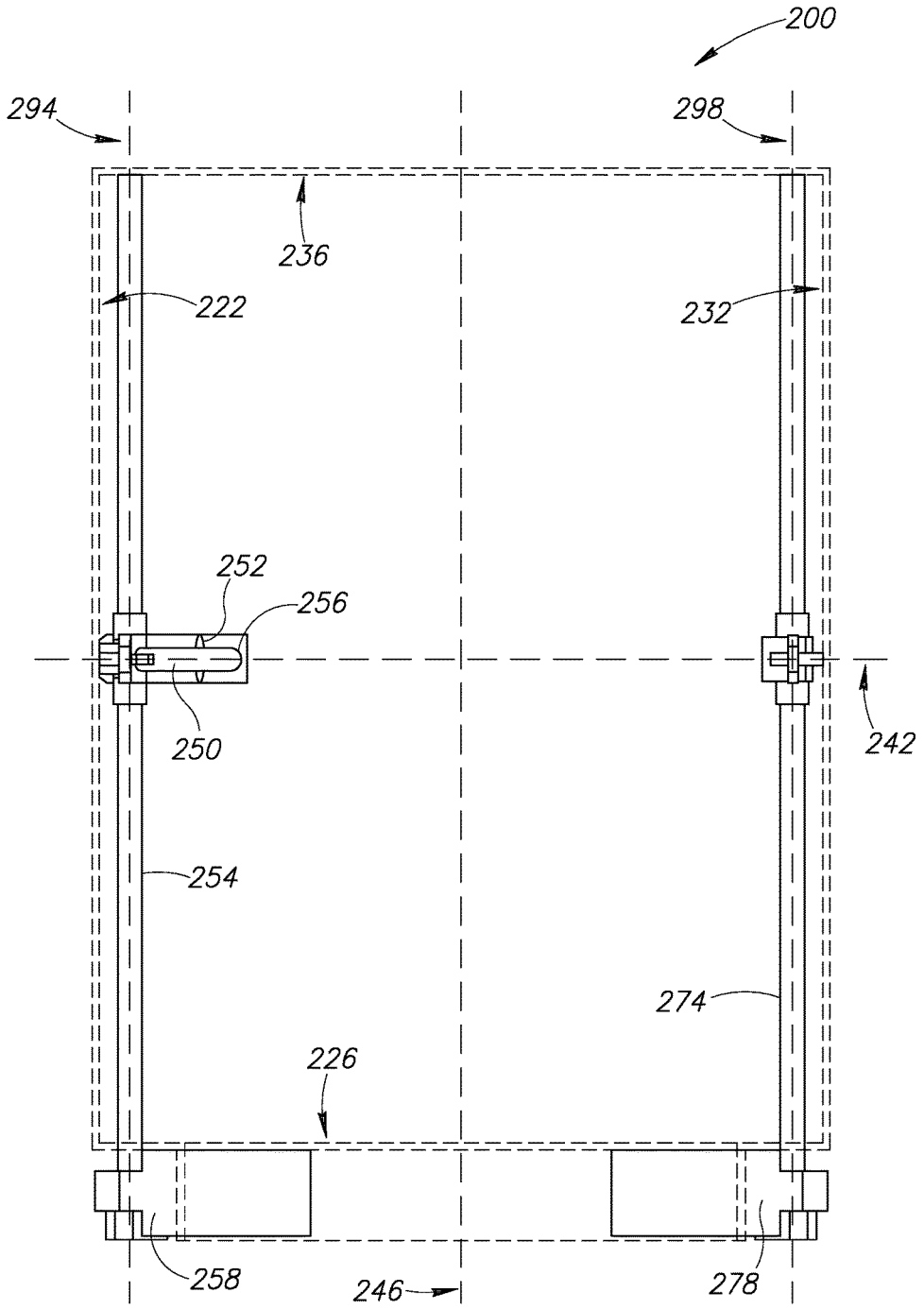
FIG. 2D shows a top view of the burn box of FIG. 2A.

FIG. 2A shows a cutaway perspective view of a burn box 200, which is consistent with various embodiments included in the heat exchanger 1000 of FIG. 1A. Burn box 200 includes a fuel agitating system. FIG. 2B shows a front view of the burn box 200 of FIG. 2A. FIG. 2C shows a side view of the burn box 200 of FIG. 2A. FIG. 2D shows a top view of the burn box 200 of FIG. 2A. As discussed herein, axes, such as rotational axes, are represented in FIGS. 2A-2D by hashed lines with large hashes.

Note that in FIGS. 2B-2D, the wall and/or surfaces of the burn box 200 are transparent to enable a clear view of the interior of burn box 200 and of the agitating system. Hashed lines indicate the transparent walls and/or surfaces of burn box 200, where the hashes associated with transparent structures are smaller than the hashes associated with axes.

In various embodiments, burn box 200 includes a front interior or internal surface 226 (as represented by lines with smaller hashes) and a rear interior surface 236. A longitudinal axis 246 (as represented by lines with larger hashes) extends between the front interior surface 226 and the rear interior surface 236 and defines a longitudinal direction of the burn box 200. The front and rear interior surfaces 226/236 are opposing surfaces. Although other embodiments need not be so constrained, as shown in the preferred embodiments of FIGS. 2A-2D, the front and rear interior surfaces 226/236 are parallel surfaces.

Burn box 200 also includes a lower interior surface 224 and an opposing upper interior surface 234. A vertical axis 244 extends between the lower interior surface 224 and the upper interior surface 234 and defines a vertical direction of the burn box 200. At least one of the lower or upper interior surfaces 224/234 is substantially orthogonal, or at least transverse to at least one of the front or rear interior surfaces 226/236. Thus, the vertical axis 244 is substantially orthogonal to the longitudinal axis 246 in some embodiments. In some embodiments, at least a portion of the lower interior surface 224 is substantially parallel to a portion of the upper interior surface 234.

In preferred embodiments, burn box 200 includes a left or first lateral or side interior surface 222 and an opposing right or second side interior surface 232. A lateral axis 242 extends between the first and second side interior surfaces 222/232 and defines a lateral direction of the burn box 200. At least one of the first or second side interior surfaces 222/232 may be orthogonal to at least one of the lower or upper interior surfaces 224/234 and at least one of the front or rear 226/236 interior surfaces. The lateral axis 242 is substantially orthogonal to at least one of the vertical axis 244 or the longitudinal axis 246. In some embodiments, at least a portion of the first side interior surface 222 is substantially parallel to a portion of the second side interior surface 232. In alternate embodiments the sides of the burn box 222 and 232 may be tapered to be wider at the bottom to allow room for the woodpile to shift, move, and settle. In another embodiment, the top and bottom may be wider than a middle portion of the sides. The narrow portion in the middle keeps the stack somewhat centered while the wider portion at the bottom allows room for efficient burn movement.

As discussed above, burn box 200 includes an agitating system for agitating or stoking the combusting fuel. The agitating system of burn box 200 includes a left or first push member 250 and a right or second push member 270. Push members 250/270 push, agitate, disturb, or otherwise stoke the burning layer of fuel within burn box 200, such as the burning layer 114 of burning woodpile 150 of heat exchanger 1000 of FIG. 1A. Push members 250/270 may include a rod, a bar, an arm, a chain (or chain grid), a cable, a combination of these members, or any other member configured and arranged to stoke or agitate a burning pile of wood within burn box 200. Thus, in some embodiments, push members 250/270 may be agitator rods, stoker members, and/or agitator members.

Each of the push members 250/270 includes an upper end disposed at the most extreme position of the upper portion of the push member 250/270 and a lower end disposed at the most extreme position of the lower portion of the push member 250/270. When activated or driven, the lower portions, and specifically the lower ends of the push members 250/270 engage, stoke, and/or disturb the burning layer 114 of the burning pile of wood 150 of FIG. 1A. In some embodiments, the lower ends of the push members 250/270 include a shaped end for agitating wood, such as a poker or pointed end. As discussed above, when the burning layer 114 is agitated, any bridging within the burning layer 114 and the drying layer 112 is de-stabilized to increase the efficiency of the combustion process occurring within burn box 200.

Burn box 200 includes a left or first coupler 260 and a right or second coupler 280. The first coupler 260 pivotally couples the first push member 250 to the first lateral interior surface 222. Likewise, the second coupler 280 pivotally couples the second push member 270 to the second lateral interior surface 232. As shown in the preferred embodiments, coupler portions of the push members 250/270 are coupled to the upper portions of the lateral side interior surfaces 222/232 respectively. Thus, the couplers 260/280 are operative to pivotally couple or fastener the push members 250/270 to the respective lateral interior surfaces 222/232 such that the lower portions are vertically below the upper portions of push members 250/270. In various embodiments, couplers 260/280 are pivotal fasteners.

As shown in FIGS. 2A-2D, the coupler portions 260/280 of the push members 250/270 are vertically between the upper and lower ends of the push members 250/270. Although other embodiments are not so constrained, the upper ends of the push members 250/270 may be pivotally coupled to the interior surfaces 222/232. The coupler portions are generally closer to the upper ends than to the lower ends, thus the coupler portions are disposed in the upper portions of the push members 250/270. As shown in at least FIG. 2B, in some embodiments, the coupler portion of the first push member 250 includes a first coupler aperture 266. Likewise, the coupler portion of the second push member 270 includes a second coupler aperture 286.

In some embodiments, first coupler 260 includes a first hook 262 and a first loop 264. The first hook 262 is rigidly coupled or fastened to the first lateral interior surface 222. The first coupler aperture 266 of the first push member 250 receives the first loop 262. The first loop 264 is hung over the first hook 262 to pivotally couple the first push member 250 to the first lateral interior surface 222. When hung as shown in FIG. 2B, the lower end of the first push member 250 is vertically intermediate the upper end of the first push member 250 and the lower interior surface 224 of burn box 200. When coupled in such a fashion, the first push member 250 may rotate about the first rotational axis 292 (as shown in FIG. 2A with a hashed line) towards the second lateral interior surface 232 of burn box 200. In various embodiments, the first rotational axis 292 is substantially aligned with the first coupling aperture 266 of first push member 250 and is substantially parallel to the longitudinal axis 246 of burn box 200.

As used herein, when discussing rotational vectors and rotation in general, a right-handed rotational convention is adopted. For instance, when discussing a rotation about an axis that is substantially parallel to the longitudinal axis 246, such as about rotational axis 292, the positive rotational vector points along the axis and in a direction that is from the rear interior surface 236 to the front internal surface 226. Thus, as shown in FIG. 2B, a positive rotation of first push member 250 occurs when first push member 250 is rotating away from first lateral interior surface 222 and towards second lateral interior surface 232. A negative rotation of first push member 250 occurs when first push member 250 is rotating away from second lateral interior surface 232 and towards first lateral interior surface 222. Accordingly, terms such as positive-sense rotation and negative-sense rotations may be applied to characterize the direction of the rotation about a given rotational axis.

Second coupler 280 is similarly constructed as first coupler 260. For example, second coupler 280 includes a second hook 282 coupled to the second lateral interior surface 232 and a second loop 284. When similarly coupled to second hook 282 via second loop 232, second push member 270 may rotate about a second rotational axis 296 (as shown in FIGS. 2A and 2C) and towards the first lateral interior surface 222.

A positive rotation of second push member 270 occurs when second push member 270 is rotating away from first lateral interior surface 222 and towards second lateral interior surface 232. A negative rotation of second push member 270 occurs when second push member 270 is rotating away from second lateral interior surface 232 and towards first lateral interior surface 222. Because the first push member 250 rotates about rotational axis 292 and the second push member 270 rotates about rotational axis 296, rotational axes 292/296 may be push member rotational axes.

The agitating system of burn box 200 also includes a first driven member 252 and a second driven member 272. Driven members 252/272 engage with and provide a rotational inducing torque on first push member 250 and second push member 270 respectively. Accordingly, driven members 252/272 may be torque members or engaging members.

For instance, as shown in FIGS. 2A-2B and 2D, first driven member 252 is configured and arranged to provide a torque on the first push member 250. When the torque provided by the first driven member 252 is a positive torque, first push member 250 rotates about the first rotational axis 292 in a positive-sense. The bottom portion of first push member 250 rotates towards the second lateral interior surface 232 to stoke or agitate the burning layer of a wood pile that is positioned laterally intermediate the first and second lateral interior surfaces 222/232. Note that a component of the force associated with the provided positive torque is directed towards the second lateral interior surface 232.

Similarly, second driven member 272 is configured and arranged to provide a torque on the second push member 270. When the torque provided by the second driven member 272 is a negative torque, second push member 250 rotates about second rotational axis 296 in a negative-sense. The bottom portion of second push member 270 rotates towards the first lateral interior surface 222 to stoke or agitate the burning layer of a wood pile that is positioned laterally intermediate the first and second lateral interior surfaces 222/232. Note that a component of the force associated with the provided negative torque is directed towards the first lateral interior surface 222.

The length of the push members 250/270, as well as the length of the driven members 252/272 may be based on the dimensions of the burn box 200 and the expected positioning and size of the burning pile or stack of fuel within the burn box 200. Preferably, the lengths are chosen such that the lower ends of the push members 250/270 engage with and agitate the burning layer of the fuel stack and destabilizes any bridging effect occurring in the woodpile.

In various embodiments, the driven members 252/272 include a lower portion and an upper portion. The upper portions of the driven members 252/272 contacts or engages with contact portions of the push members 250/270, to provide the torque on the push members 250/270. The contact portions of push members 250/270 are vertically between the coupler portions and the lower ends of the push members 250/270. As discussed further below, such a contact or engagement induces the torque that rotates the push members 250/270 about the rotational axis 292/296 respectively.

As shown in at least FIG. 2A, in order to provide the torque on the push members 250/260, the driven members 252/272 are configured and arranged to rotate about driven member rotational axes 294/298 (as shown in at least FIGS. 2A and 2D), respectively. Driven member rotational axes 294/298 intersect the lower portions of driven members 252/272 respectively and are each substantially parallel to the push member rotational axes 292/296. Driven member rotational axes 294/298 are vertically below the push member rotational axes 292/296. When the first driven member 252 rotates, in a negative-sense, about driven member rotational axis 294, first push member 250 rotates in a positive-sense about push member rotational axis 292.

In preferred embodiments, the agitating system of burn box 200 includes a first drive member 254 and a second drive member 274. First drive member 254 is configured and arranged to drive the rotation of first driven member 252 about driven member rotational axis 294. Likewise, second drive member 274 is configured and arranged to drive the rotation of second driven members 272 about driven member rotational axis 298.

Drive members 254/274 may be drive rods or drive components and drive the respective driven members 252/272. First drive member 254 is configured and arranged to rotate about driven member rotational axis 294. Likewise, second drive member 274 is configured and arranged to rotate about driven member rotational axis 298. Accordingly, driven member rotational axes 294/298 may be drive member rotational axes.

In order to drive the rotation, first drive member 254 is rigidly coupled to the first driven member 252. Likewise, the second drive member 274 is rigidly coupled to the second driven member 272. Due to this rigid coupling, when the drive members 254/274 are rotated about the respective drive member axes 294/294, the respective driven members 252/272 are co-rotated in the same sense and also by the same angular displacement. Accordingly, when the first drive member 254 is rotated in a negative-sense, the first driven member 252 is co-rotated to engage with and provide torque to the first push member 250. A negative rotation of the first drive member 254 drives the positive rotation of the first push member 250 about push member rotational axis 292. Likewise, a positive rotation of second drive member 274 drives a negative rotation of the second push member 270 about the push member rotational axis 296. Drive members 254/274 may extend beyond the exterior of the burn box 200 such that the drive members 254/274 (as well as the driven members 252/272 and the push members 250/270) are rotatable from the exterior region of burn box 200.

In preferred embodiments, the driven members 252/272 are operative to return the push member 250/270 to the lateral interior surfaces 222/232 respectively. This feature enables multiple successive agitations of the woodpile and insures the push members 250/270 do not become lodged or stuck within the burn wood. Other embodiments are not so constrained, and may rely on gravity alone to return push members 250/270 to a substantially vertical orientation.

As shown in at least FIG. 2A, each of driven members 252/272 includes an upper surface. A first upper receiving aperture 256 is positioned in the upper surface of first driven member 252. The first receiving aperture 256 is configured and arranged to slidably receive the lower end or lower portion of first push member 250. When the driven member 252 rotates about driven member rotational axis 294, the first push member co-rotates about push member axis 292, as well as slides along first receiving aperture 256 of the first driven member 252. The surfaces of first receiving aperture 256 engage with the first push member 250. This engagement enables first driven member 252 to provide both positive and negative torques to first push member 250. Accordingly, first drive member 252 is operative (via negative rotation about rotational axis 294) to rotate first push member 250 towards second lateral interior surface 232 (positive rotation) and (via positive rotation about rotational axis 294) back towards the first lateral interior surface 222 (negative rotation). First drive member 254 is configured and arranged to return first push member 250 back to a substantially vertical orientation. Accordingly, first drive member 254 is operative to both "push" (towards second lateral interior surface 232) and "pull" (away from second lateral interior surface 232) first push member 250. Other embodiments may be operative to only "push" on push members 250/270 and rely on gravity to assist with returning the push members 250/270 to the initial vertical position.

Similarly, second driven member 272 includes a second receiving aperture 276. Thus, first drive member 252 is operative (via positive rotation about rotational axis 298) to rotate second push member 270 both towards first lateral interior surface 222 (negative rotation) and (via negative rotation about rotational axis 298) back towards the second lateral interior surface 232 (positive rotation).

As driven members 252/272 and push members 250/270 co-rotate, the angle between the driven and push member pairs varies. For instance, FIG. 2B shows angle $\alpha$ between first push member 250 and first driven member 252. Note that angle $\alpha$ is within a plane that is substantially orthogonal to the rotational axes 292/296. In various embodiments, the lateral width of at least one of the receiving apertures 256/276 is large enough to slidable receive the corresponding push members 250/270, so that the angle $\alpha$ between the push members 250/270 and corresponding driven members 252/272 varies between at least 130 and 180 degrees. In other embodiments, the lateral width of the receiving apertures 256/276 may be varied to accommodate other ranges of the variable angle between push members 250/270 and corresponding driven members 252/272.

In some embodiments, the agitating system of burn box 200 further includes a first actuator 258 and a second actuator 278. First actuator 258 is operative to rotate first push member 250. Likewise, second actuator 278 is operative to rotate second push member 270. In preferred embodiments, first actuator 258 is operative to rotate first drive member 254, about drive member rotational axis 294, to drive the rotation of first push member 250 about the push member rotational axes 292. Similarly, second actuator 278 is operative to rotate second drive member 274, about drive member rotational axis 298, to drive the rotation of second push member 270 about the push member rotational axes 296.

Actuators 258/278 may provide both positive and negative torque so that the push members 250/270 are both "pushed" and "pulled" when stoking a woodpile. The actuators 258/278 may be electro-mechanical actuators. For instance, the actuators 258/278 may include motors. In some embodiments, actuators 258/278 may automatically rotate push members 250/270 to automatically stoke the woodpile within burn box 200.

In the embodiments shown in FIGS. 2A-2D, actuators 258/278 are positioned external to the burn box 200 to protect the actuators 258/278 from the thermal energy within burn box 200. In such embodiments, the actuators 258/278 may be coupled to portions of drive members 254/274 that are external to burn box 200. In at least one embodiments, components of the actuators 258/278 may be housed within heat or fire resistant housings to protect heat sensitive components. Actuators 258/278 may include one or more processor devices, networking devices, memory devices, timer devices, or sensing devices. Such devices may enable a remote control and/or autonomous operation of the agitating system In various embodiments of an autonomous agitating system, the system may be automatically triggered via one or more triggering events. Such triggering events may be indicative of a situation where initiating or terminating an ongoing agitation sequence is beneficial regarding the operation or safety associated with the operation of the heat exchanger. Such triggering events include, but are not limited to closing the access door 202 to the burn box 200, an excessive load on the actuators 258/278, or a dramatic increase/decrease of the rate of combustion or temperature within burn box 200.

Various sensors may be included in the agitating system to detect one or more of possible triggering events. When a triggering event is detected, depending upon the current operation of the system and the nature of the detected event, the agitating system may either initiate an agitating sequence, or terminate an ongoing sequence. In response to a triggering event, an alert may be provided to a user. The alert may be an audible alert and/or a visual alert. The alert may be provided to a mobile user device, such as a smartphone, tablet, or other networked computing device via a network device included in the system. The alert may include data regarding the nature of the triggering event, as well as a time, date, and/or geo-stamp.

For instance, the actuators 258/278 may include torque or load sensors. When a torque sensor senses a torque or load greater than the load rating of a motor within the actuator, the motor may shut down. In the event that the woodpile becomes lodged or one of the push members 250/270 become ensnared in a particular stable bridge formed in the woodpile, such torque sensors prevent damage to the actuators 258/278. An alert may be provided to the user to indicate to the user that a manual stoking of the combustion may be required to dislodge the stuck push member 250/270. The actuators 258/278 may then automatically or manually be reset.

Other triggering events may include the closing of the door 202, such as when a user re-supplies wood for the combustion process. The agitating system of burn box 200 may include a door sensor that generates a signal is transitioned from an open state to a closed state. A signal generated from closing the door may initiate an agitation sequence. For instance, after adding wood to the fire, the woodpile may be agitated on regular intervals. Accordingly, after sensing a closing of the door 202, the agitating system may agitate the woodpile, every two hours, or any other constant or variable timing sequence. In at least one embodiment, the time sequence is programmable by a user.

The agitating sequence may be a lateral alternating sequence in time. For instance, actuators 259/278 may be operative to rotate the push members 250/270 sequentially in an alternating sequence. While first push member 250 is being rotated towards second interior surface 232, second push member 270 is not being rotated towards second interior surface 232 so that push members 250/270 are not simultaneously push on the wood in opposite directions. Such an operation may put the pile of wood under compression and may decrease the efficiency of stoking of the woodpile.

In at least one embodiment, the agitation system includes at least one of an oxygen sensor, a carbon monoxide sensor, or a temperature sensor that is enabled to sense conditions within the burn box 200. The agitation system may initiate or terminate an agitating sequence based on signals generated by at least one of these sensors. Furthermore, a wireless transceiver device, such as a WIFI or a BLUETOOTH transmitter, may be included in the agitation system. Such a wireless transceiver is operative to receive a wireless signal generated by a remote or mobile device, such as a smartphone or tablet. Accordingly, the agitation system may be remotely operated and/or programmed.

All of the embodiments and methods disclosed and claimed herein can be made and executed without undue experimentation, in light of the present disclosure. While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A burn box that houses burning wood, the burn box comprising:

a first interior surface;

a second interior surface that opposes the first interior surface; and a first agitator member that includes a first stoker portion, wherein the first stoker portion is positioned closer to the first interior surface than to the second interior surface such that the burning wood is positioned intermediate the first stoker portion and the second interior surface, wherein the first agitator member is configured and arranged to be driven such that the first stoker portion moves towards the second interior surface to agitate the burning wood, and a first driven member that engages the first agitator member, wherein, when the first driven member is driven, the first driven member and the first agitator member co-rotate in opposing directions.

2. The box of claim 1 wherein the first driven member engages the first agitator member such that, when the first driven member is driven in a first direction, the first driven member applies a first force on the first agitator member, wherein the first force is at least partially directed toward the second interior surface so that the first stoker portion moves toward the second interior surface.

3. The box of claim 2, wherein, when driven in a second direction, the first driven member applies a second force on the first agitator member that is at least partially directed toward the first interior surface so that the first stoker portion moves toward the first interior surface.

4. The box of claim 1, wherein, when the first driven member is driven in the first direction, the first driven member and the first agitator member co-rotate in opposing directions such that a first angle between the first driven member and the first stoker portion is varied.

5. The box of claim 1, further comprising:

a first actuator that is operative to drive the first agitator member in a first direction that is toward the second interior surface.

6. The box of claim 5, further comprising:

a first drive component that is coupled to the first actuator and the first driven member, wherein the first actuator is operative to trigger the first drive component to drive the first driven member in the first direction.

7. The box of claim 6, wherein the first actuator is coupled to a portion of the first drive component that is positioned external to the box.

8. The box of claim 6, further comprising a transceiver device that is operative to receive a wireless signal generated by a remote device, wherein the first actuator is operative to trigger the first drive component to drive the first driven member in the first direction in response to the transceiver device receiving the received wireless signal.

9. The box of claim 5, wherein the first actuator includes a first torque sensor that is operative to terminate driving the first driven member when the first torque sensor senses a first torque that is greater than a predetermined torque value.

10. The box of claim 1, further comprising:

a first drive component that is rigidly coupled to the first driven member that engages the first agitator member, wherein the first drive component is configured and arranged to rotate about a first rotational axis that is substantially orthogonal to a line extending between the first and the second interior surfaces, wherein, when the first drive component is rotated about the first rotational axis, the first driven member is driven in a first direction and the first agitator member rotates about a second rotational axis that is substantially parallel to and vertically above the first rotational axis.

11. The box of claim 10, wherein, when the first drive component is rotated in a first rotational direction, the first agitator member is rotated in another rotational direction that is substantially parallel to and opposing the first rotational direction.

12. A system for agitating a pile of wood in a box, the system comprising:

a first agitator rod that includes a first end and a second end;

a first pivotal fastener that is operative to pivotally couple the first agitator rod to an upper portion of a first lateral internal surface of the box such that the second end of the first agitator rod is vertically between a lower internal surface of the box and the first end of the first agitator rod;

a first drive rod that is configured and arranged to rotate about a first rotational axis that extends between a front internal surface of the box and an opposing rear internal surface of the box; and a first engaging member that is rigidly coupled to the first drive rod, wherein the first engaging member engages the first agitator rod such that, when the first drive rod is rotated in a first direction about the first rotational axis, the first engaging member engages the first agitator rod such that the second end of the first agitator rod rotates in a second direction about a second rotational axis and towards a second lateral internal surface of the box that opposes the first lateral internal surface, wherein the second rotational axis is substantially parallel to the first rotational axis, and wherein the second direction opposes the first direction.

13. The system of claim 12, wherein, when the first drive rod is rotated in a third direction that is opposite the first direction, the first engaging member engages the first agitator rod such that the second end of the first agitator rod rotates about the second longitudinal axis and towards the first lateral internal surface of the box.

14. The system of claim 12, wherein the first engaging member includes an upper surface and an aperture positioned on the upper surface, and the aperture is configured and arranged to slidably receive the second end of the first agitator rod such that when the first drive rod rotates about the first longitudinal axis, the first agitator rod slides along a surface of the aperture.

15. The system of claim 14, wherein a lateral width of the aperture is large enough to slidably receive the second end of the first agitator rod, wherein the first agitator rod and the first engaging member form an angle in a plane that is substantially orthogonal to the first rotational axis, and the angle is between 130 and 180 degrees.

16. The system of claim 14, wherein the surface of the aperture of the first engaging member engages with the first agitator rod to rotate the second end of the first agitator rod about the second rotational axis.

17. The system of claim 12, wherein the first rotational axis is vertically below the second rotational axis.

18. The system of claim 12, further comprising:

a first actuator that is coupled to the first drive rod and positioned external to the box, wherein the first actuator is operative to rotate the first drive rod about the first rotational axis.

19. The system of claim 18, wherein the first actuator is further operative to rotate the first drive rod based on at least one of an agitation periodicity or a time lapse since a previous agitation event.

20. The system of claim 18, further comprising:

at least one of a door sensor, a timer, a temperature sensor, or a gas sensor, wherein the first actuator is further operative to rotate the first drive rod based on at least a signal generated by at least one of the door sensor, the temperature sensor, or the gas sensor.

21. The system of claim 12, further comprising:

a second agitator rod that includes a third end and a fourth end;

a second pivotal fastener that is operative to pivotally couple the second agitator rod to an upper portion of the second lateral internal surface of the box such that the fourth end of the second agitator rod is vertically between the lower internal surface of the box and the third end of the second agitator rod;

a second drive rod that is configured and arranged to rotate about a third rotational axis that extends between the front internal surface of the box and the rear internal surface of the box; and a second engaging member that is rigidly coupled to the second drive rod, wherein the second engaging member engages the second agitator rod such that, when the second drive rod is rotated in a third direction about the third rotational axis, the second engaging member engages the second agitator rod such that the fourth end of the second agitator rod rotates in a fourth direction about a fourth rotational axis and towards the first lateral internal surface of the box, wherein the fourth rotational axis is substantially parallel to the first rotational axis, and wherein the fourth direction opposes the third direction.

22. A burn box that houses burning wood, the burn box comprising:

a front interior surface;

a rear interior surface, wherein a first axis extends between the front interior surface and the rear interior surface;

a first side interior surface;

a second side interior surface that opposes the first side interior surface;

a lower interior surface;

an upper interior surface that opposes the lower interior surface;

a first push member that includes a first end, a second end, and a first coupler portion intermediate the first end and the second end;

a first coupler that pivotally couples the first coupler portion of the first push member to the first interior surface such that the second end is vertically intermediate the first end and the lower interior surface; and a first torque member that is configured and arranged to rotate in a second direction about a second rotational axis to provide a first torque to the first push member, wherein, when the first torque is provided to the first push member, the first push member rotates in a first direction about a first rotational axis that extends through the first coupler portion of the first push member and that is substantially parallel to the longitudinal axis such that the second end rotates toward the second side interior surface, wherein the second direction opposes the first direction.

23. The box of claim 22, wherein the first torque member includes a lower portion and an upper portion that contacts a contact portion of the first push member that is vertically intermediate the second end and the coupler portion of the first push member, wherein the second rotational axis is substantially parallel to the first rotational axis such that, when the upper portion rotates toward the second side interior surface, the upper portion provides the first torque on the first push member.

24. The box of claim 22, further comprising:

a first drive member that is rigidly coupled to the first torque member, wherein the first drive member is configured and arranged to rotate about the second rotational axis, wherein the second rotational axis is substantially parallel to the first rotational axis, wherein, when the first drive member is rotated about the second rotational axis, the first torque member engages the first push member to provide the first torque.

25. The box of claim 24, wherein the first drive member extends between the front interior surface and the rear interior surface along the second rotational axis.

26. The box of claim 24, further comprising:

an actuator that is configured and arranged to automatically rotate the first drive member about the second rotational axis.

27. The box of claim 24, wherein the first drive member extends beyond an exterior surface of the box such that the first drive member is rotatable from an exterior region of the box.

28. The box of claim 22, further comprising:

a second push member that includes a third end, a fourth end, and a second coupler portion intermediate the third end and the fourth end;

a second coupler that pivotally couples the second coupler portion of the second push member to the second interior surface such that the fourth end is vertically intermediate the third end and the lower interior surface; and a second torque member that is configured and arranged to rotate in a fourth direction about a fourth rotational axis to provide a second torque to the second push member, wherein, when the second torque is provided to the second push member, the second push member rotates in a third direction about a third rotational axis that extends through the second coupler portion of the second push member and that is substantially parallel to the longitudinal axis such that the fourth end rotates toward the first side interior surface, wherein the fourth direction opposes the third direction.

29. The box of claim 28, further comprising:

a first actuator configured and arranged to automatically rotate the first torque member about the second rotational axis, wherein the second rotational axis is substantially parallel to the first rotational axis, wherein, when the first torque member is rotated about the second rotational axis, the first torque member engages the first push member to provide the first torque; and a second actuator configured and arranged to automatically rotate the second torque member about the fourth rotational axis, wherein the fourth rotational axis is substantially parallel to the first rotational axis, wherein, when the second torque member is rotated about the fourth rotational axis, the second torque member engages the second push member to provide the second torque.

30. The box of claim 29, wherein the first and second actuators are operative to rotate the first and second torque members sequentially such that the first torque is provided to the first push member and the second torque is provided to the second push member in a temporally alternating sequence.

31. The box of claim 22, further comprising:

a door that provides access to an interior of the box;

a door sensor that generates a signal when the door is transitioned from an open state to a closed state; and an actuator that is operative to initiate the first torque member providing the first torque to the first push member based on receiving the signal generated by the door sensor.

* * * * *